US010058727B2

(12) United States Patent
Smith

(10) Patent No.: US 10,058,727 B2
(45) Date of Patent: Aug. 28, 2018

(54) EXERCISE APPARATUS AND METHODS

(71) Applicant: Brent Smith, Bentonville, AR (US)

(72) Inventor: Brent Smith, Bentonville, AR (US)

( * ) Notice: Subject to any disclaimer, the term of this patent is extended or adjusted under 35 U.S.C. 154(b) by 1241 days.

(21) Appl. No.: 13/624,258

(22) Filed: Sep. 21, 2012

(65) Prior Publication Data

US 2013/0274076 A1 Oct. 17, 2013

Related U.S. Application Data

(60) Provisional application No. 61/537,982, filed on Sep. 22, 2011.

(51) Int. Cl.

| | |
|---|---|
| ***A63B 21/065*** | (2006.01) |
| ***A63B 21/072*** | (2006.01) |
| ***A63B 22/18*** | (2006.01) |
| ***A63B 23/12*** | (2006.01) |
| ***A63B 21/00*** | (2006.01) |
| *A63B 5/00* | (2006.01) |
| *A63B 21/06* | (2006.01) |
| *A63B 23/02* | (2006.01) |

(52) U.S. Cl.

CPC ..... *A63B 21/065* (2013.01); *A63B 21/0607* (2013.01); *A63B 21/072* (2013.01); *A63B 21/4035* (2015.10); *A63B 22/18* (2013.01); *A63B 23/1236* (2013.01); *A63B 5/00* (2013.01); *A63B 21/0602* (2013.01); *A63B 23/0222* (2013.01); *A63B 2022/185* (2013.01)

(58) Field of Classification Search

CPC ... A63B 21/1469; A63B 23/16; A63B 21/072; A63B 23/1236; A63B 21/0608; A63B 23/03508; A63B 23/14; A63B 21/06; A63B 21/1484; A63B 43/02; A63B 21/1449; A63B 21/1438; A63B 2021/0722; A63B 21/065; A63B 43/00; A63B 69/0059; A63B 39/00; A63B 21/1442; A63B 37/00; A63B 37/06; A63B 21/0004

USPC ..... 482/44–50, 92–93, 106, 108, 141, 148

See application file for complete search history.

(56) References Cited

U.S. PATENT DOCUMENTS

| | | | | | |
|---|---|---|---|---|---|
| 113,966 | A | * | 4/1871 | Ballou | 482/108 |
| 421,447 | A | * | 2/1890 | Stewart | 2/18 |
| 3,185,476 | A | * | 5/1965 | Fechner | 473/596 |
| 3,347,240 | A | | 10/1967 | Rigler | |
| D242,865 | S | | 12/1976 | Stamm | |
| D244,628 | S | * | 6/1977 | Wright | D21/682 |
| 4,813,669 | A | * | 3/1989 | Caruthers | 482/108 |
| 4,880,228 | A | * | 11/1989 | Caruthers | 482/108 |
| 4,896,880 | A | * | 1/1990 | Caruthers | 482/108 |
| 4,900,016 | A | * | 2/1990 | Caruthers | 482/108 |
| 5,009,416 | A | * | 4/1991 | Caruthers | 482/139 |
| 5,139,472 | A | * | 8/1992 | Caruthers | 482/93 |
| 5,302,165 | A | * | 4/1994 | Caruthers | 482/108 |
| 5,342,268 | A | * | 8/1994 | Caruthers | 482/108 |
| 5,496,244 | A | * | 3/1996 | Caruthers | 482/108 |
| D372,945 | S | * | 8/1996 | Morgan | D21/682 |
| 6,672,993 | B2 | * | 1/2004 | Stout | 482/55 |

(Continued)

*Primary Examiner* — Joshua Lee

(74) *Attorney, Agent, or Firm* — Dergosits & Noah LLP

(57) ABSTRACT

An exercise device and methods for using the exercise device. The exercise device is a spherical structure having a rigid surface and an opening therein for the user's hand to grasp a handle affixed in the center of the spherical structure. A series of exercises may be performed with the exercise device, including push-ups, rows and swings.

15 Claims, 6 Drawing Sheets

(56) References Cited

U.S. PATENT DOCUMENTS

| | | | | |
|---|---|---|---|---|
| D515,652 | S * | 2/2006 | McCreath | D21/798 |
| 7,306,464 | B2 * | 12/2007 | Long et al. | 434/247 |
| 7,585,262 | B1 * | 9/2009 | Vayntraub | 482/141 |
| 7,789,810 | B2 * | 9/2010 | Le | 482/83 |
| 8,485,948 | B2 * | 7/2013 | Cen | 482/108 |
| 2003/0134727 | A1 * | 7/2003 | Yu | 482/110 |
| 2006/0211545 | A1 | 9/2006 | Smyer | |
| 2008/0214368 | A1 * | 9/2008 | Cao | 482/108 |
| 2010/0257651 | A1 * | 10/2010 | Anderson et al. | 2/18 |
| 2011/0247124 | A1 * | 10/2011 | Stack | 2/161.1 |
| 2012/0149536 | A1 | 6/2012 | Trimble et al. | |
| 2013/0059701 | A1 * | 3/2013 | Santa Cruz et al. | 482/108 |

* cited by examiner

EXERCISE APPARATUS AND METHODS

TECHNICAL FIELD

This disclosure relates generally to the field of exercise, and more particularly, to an exercise device and methods for its use.

BACKGROUND

Exercise continues to be an important part of an individual's health and fitness regimen. Further, the advent of new sports, like mixed martial arts, as well as a better understanding of physiology and how the body responds to stimuli, has led to new ways of training the human body with exercise. To that end, a multitude of exercise devices are commercially available that are alleged to provide various fitness benefits for the user, none of which are truly simple and multifunctional.

Existing rotating push-up bars typically rotate as the user extends their arms in a push-up position, but these bars are generally fixed in a system that only allows the bar to turn, and does not provide instability for proprioception. A kettlebell is a simple cast-iron ball having a handle that is frequently used for ballistic and swinging movements. However, kettlebells are limited in their functionality because the handle extends from the top of the ball. This means that the weight is not distributed evenly about the hand, but away from the hand, and this may cause some unwieldy flopping motions including banging it into the user when trying to use a kettlebell. Standard dumbbells do not move, rotate or engage proprioception if a user attempts to do upper body push exercises, and thus are also limited in effect.

It would be desirable to have an apparatus that allows the user to perform isolated as well as compound exercises in a workout program using a standard set of widely accepted functional movements.

DETAILED DESCRIPTION

Figure 1B:
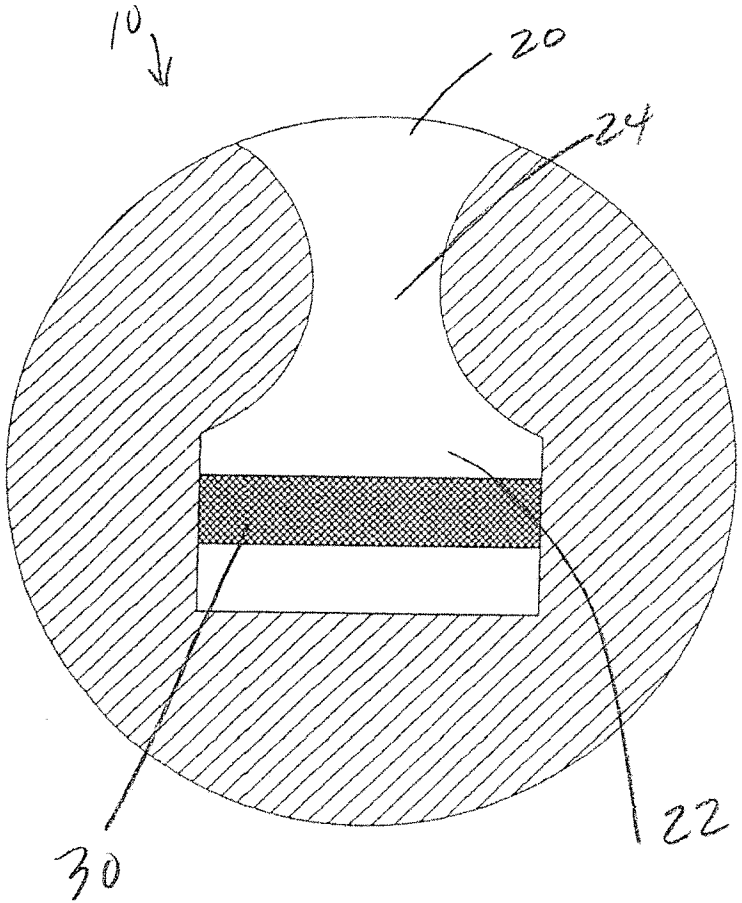
FIG. 1B is a plan view of the exercise ball of FIG. 1A taken across the section 1B-1B.
Figure 1A:
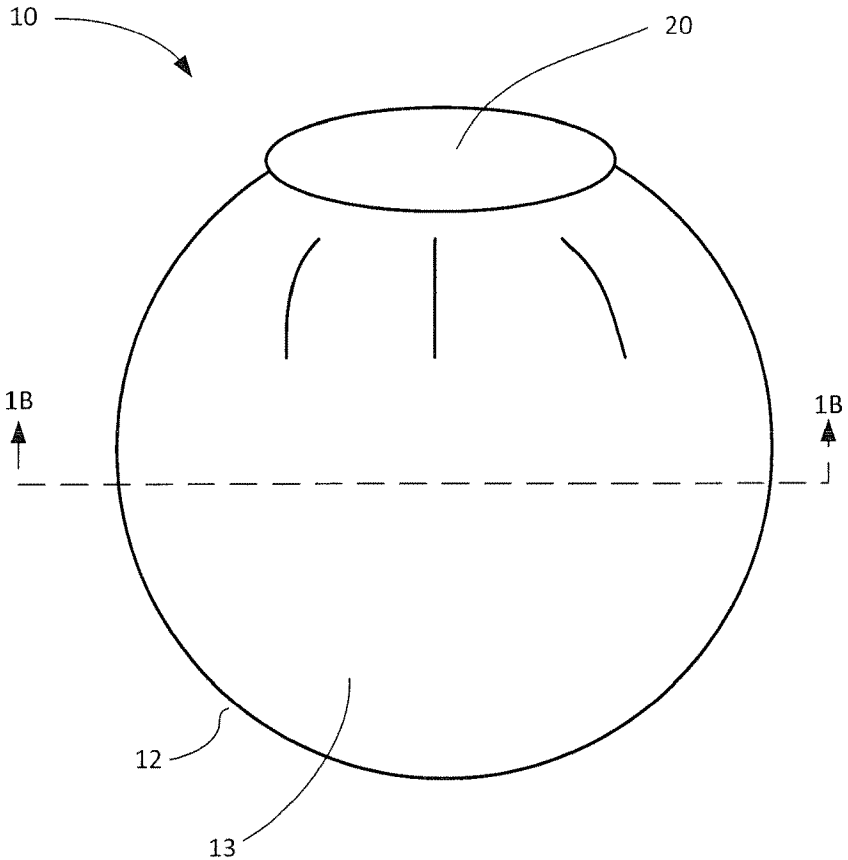
FIG. 1A is a perspective view of an exercise ball.

Referring now to FIGS. 1A and 1B, an exercise ball 10 is illustrated. The exercise ball 10 is a heavy, partially hollow structure 12 having a spherical shape. It may be made in different sizes and weights, for example, ranging from 8 to 20 inches in diameter and/or ranging in weight from 5 pounds to 150 pounds. Smaller balls will be lighter and easier to use in exercises, while incrementally larger balls will also be proportionately heavier.

A circular opening 20 is formed in the surface of the ball structure 12, a cavity 22 is formed in the center of the ball structure, and a passageway 24 connects the opening to the cavity. A handle 30 is affixed across the center of the cavity 22 in the center of the ball 12. The user reaches in through the opening 20 and passageway 24 to grasp the handle 30 in the cavity 22 to hold the ball 10 for use in exercises.

In one embodiment, the ball structure 12 is hollow and its surface is formed with a solid metal or hard plastic material. Preferably, the surface has an outer covering 13, although not required. For example, a suitable metal such as cast iron having the desired weight may be melted and formed in a mold to the desired shape, then covered with layer of rubber or plastic. However, anything hard and heavy that can be made into a round ball and hollowed out would work. The outer covering 13 is preferably vulcanized rubber, which is adhered to the metal through thermal treatment, such as exposure to hot air or microwaves. Other covering materials may also be used and may be fastened to the surface of the ball structure 12 with a suitable adhesive like epoxy such that the covering does not shift or gape when the ball is in use. Alternatively, the ball structure 12 may be dipped into a rubber or plastic resin coating material to fully coat all surfaces of the structure.

In another embodiment, the ball structure 12 could be formed entirely of vulcanized rubber. molded plastic or other suitable combinations of materials. In yet another embodiment, the ball structure 12 may be filled with a fill material, such as resin, sand, water or even concrete. Such a structure should be formed with no seams or holes through which the fill material could leak out.

The opening 20 and passageway 24 are adequately sized to accommodate the hand, wrist and part of the forearm of the user to reach into the cavity 22 and grab the handle 30. For example, the opening 20 is preferably circular and should be no more than 4.5 inches in diameter to accommodate most users. However, it is cautioned that the size of the opening should not be made too large as the smaller size helps to limit movement at the top of the opening for push and rotation exercises. Limiting this movement helps prevent damage to the proximal and distal radioulnar joints while effectively engaging the major and tertiary muscle of the torso and arms.

The passageway 24 and cavity 22 extend slightly further into the ball than its radius since the handle will preferably be at the mid-point and the hand needs room to wrap around the handle. The passageway 24 is preferably narrower at the surface, as shown in FIG. 2, expanding as it moves toward the cavity 22. Of course, it is possible to make different size balls with different size openings for different users, such as small (for youth or small adults), medium (for typical adult), large or extra large.

The handle 18 is preferably formed as a solid cylinder made entirely of metal, but could also be formed as a hollow metal cylinder, or coated with rubber or plastic, or made entirely from rubber or plastic. In one embodiment, the handle is integrally formed with the ball structure out of a single piece of metal material by melting the metal and forming in a mold. A single integral high strength plastic piece could also be molded. In another embodiment, the handle 18 is formed as a metal cylinder and is attached to the edges of passage 16, for example, with threaded fasteners, by weldment, or other known attachment techniques.

As noted above, the handle 18 should preferably be in the approximate center of the spherical shape for best results, but could also be moved slightly off-center for comfort or for more advanced exercise positioning. It is noted, however, that functionality decreases if the handle is too far off-center or above the midline, by placing undue stress on the user's joints (wrists, shoulders, etc.).

Once the user has reached into the ball and grasped the handle, there are numerous exercises which may be performed, and several are described below with accompanying figures. All exercises described herein should be performed in reasonable sets of reasonable repetitions consistent with the fitness of the user.

Exercise 1:

Step i: With a ball on each hand, place the balls on the ground in front of you and stabilize in a standard push up ready position, as in FIG. 2A. This is the Start position.

Figure 2A:
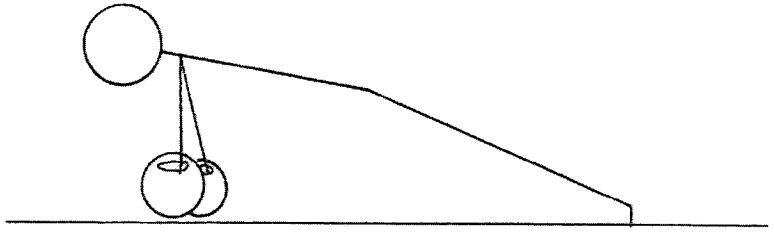
FIGS. 2A-2D illustrate a first series of exercises using the exercise ball of FIG. 1.
Figure 2B:
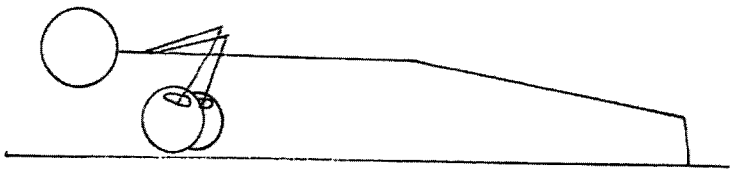

Step ii: Drop down (like a push-up) until the chest is even with the top of the balls, as shown in FIG. 2B.

Figure 2C:
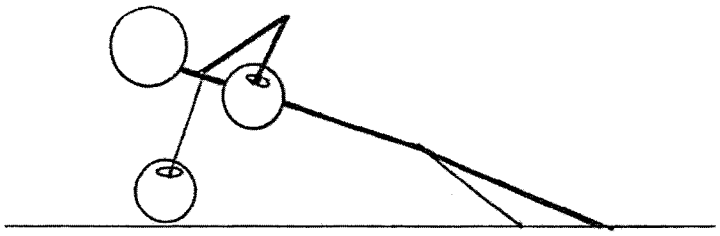

Step iii: Push up with the right hand while the left hand "rows," i.e., pulls the ball up to even with the torso, as shown in FIG. 2C; return to Start position.

Figure 2D:
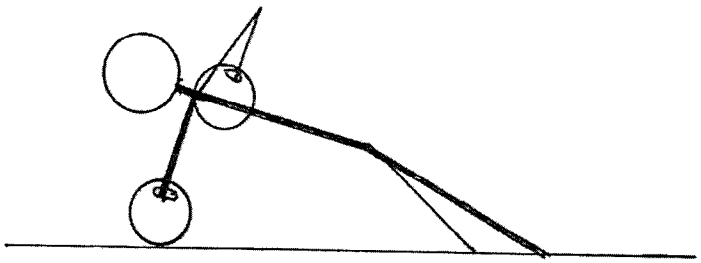

Step iv: Push up with the left hand while the right hand "rows" as shown in FIG. 2D; return to Start position.

The primary muscles worked in Exercise 1 are the chest, shoulders, back and core.

Figure 3A:
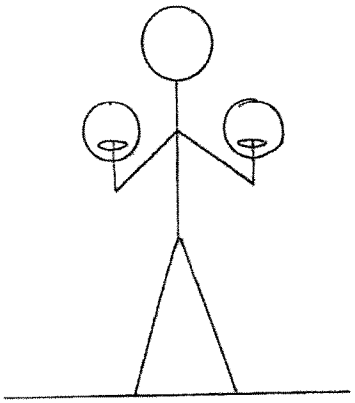
FIGS. 3A-3F illustrate a second series of exercises using the exercise ball of FIG. 1.

Exercise 2:

Step i: With a ball in each hand, stand with feet set wider than shoulders and balls held up near shoulders, as shown in FIG. 3A. This is the Start position.

Figure 3B:
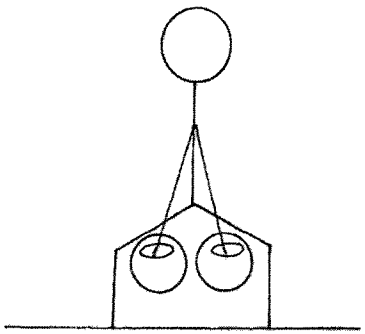
Figure 3C:
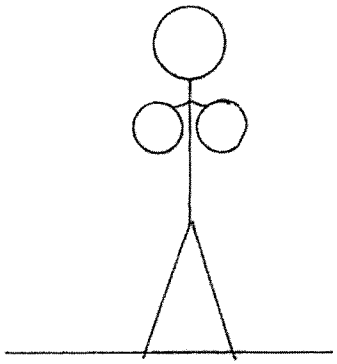

Step ii: Drop the balls in a small arc between the legs, which forces you to drop down, as shown in FIG. 3B. Make sure to maintain good squat posture, and hold chest up;

Step iii: Continuing from step ii, push up with the feet to swing the balls back up in a small arc, pulling with the upper body, and maintaining good posture with chest out and back straight, as shown in FIG. 3C.

Figure 3D:
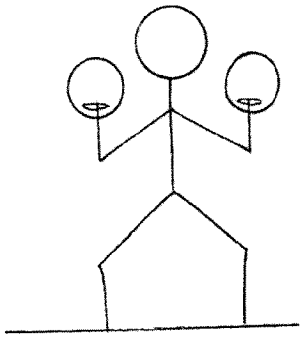
Figure 3E:
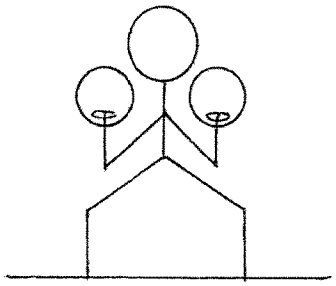

Step iv: Continuing from step iii, at the top of arc, absorb the weight of the balls by dropping down in a squat with the balls positioned even with the shoulders, as shown in FIGS. 3D and 3E.

Figure 3F:
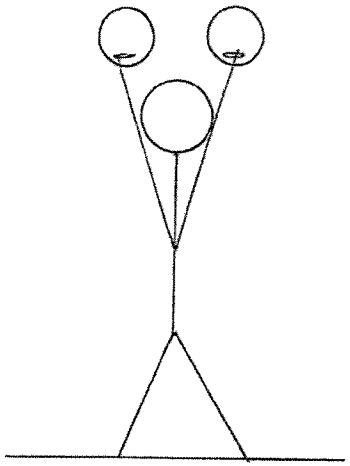

Step v: From the squat position of FIG. 3E, push up with the feet to push the balls straight back up all the way over the head, while maintaining good posture with chest out and back straight, until your arms and balls are extended fully over your head, as shown in FIG. 3F. Return to Start position.

The primary muscles worked in Exercise 2 are the hamstrings, glutes, quadriceps and shoulders.

Figure 4A:
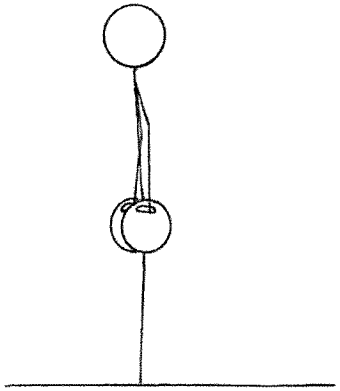
FIGS. 4A-4E illustrate a third series of exercises using the exercise ball of FIG. 1.

Exercise 3:

Step i: With a ball in each hand, stand with feet set shoulder width apart and balls held resting down against your sides, as shown in FIG. 4A. This is the Start position.

Figure 4B:
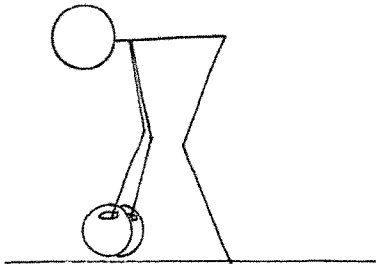

Step ii: Place the balls down on the ground in front of you approximately shoulder width apart, as shown in FIG. 4B.

Figure 4C:
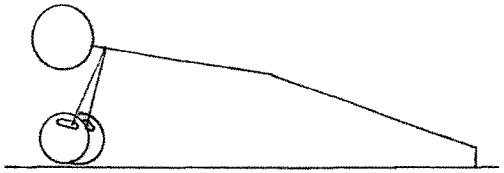

Step iii: In a single movement, pop your legs straight back out to a push-up type position, with the toes curled under and the feet spread apart roughly the same distance as the balls, as shown in FIG. 4C.

Figure 4D:
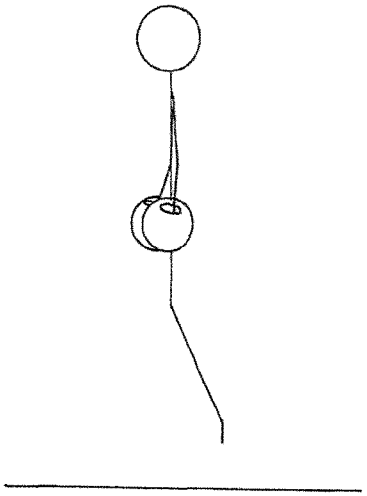

Step iv: Pop your legs back to the position of step ii and then jump into the air, keeping the balls at your side, as shown in FIG. 4D.

Figure 4E:
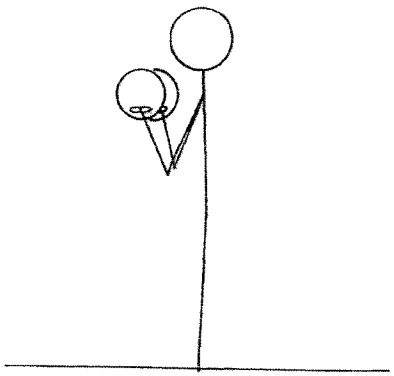

Step v: Land, then curl the balls up in front of your chest, as shown in FIG. 4E. Return to Start position.

The primary muscles worked in Exercise 3 are the core, shoulders, quadriceps, calves and biceps.

Figure 5A:
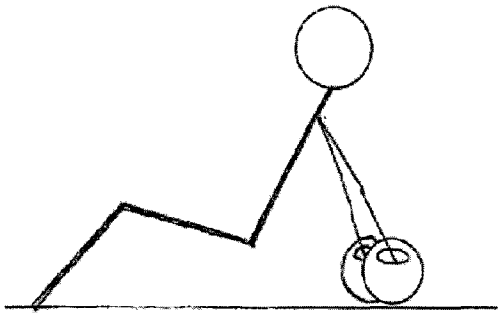
FIGS. 5A-5D illustrate a fourth series of exercises using the exercise ball of FIG. 1.

Exercise 4:

Step i: Start by placing the balls on the ground approximately shoulder width apart, with your feet on the ground and together in front of you, with knees bent and hips raised off the ground and positioned slightly in front of the balls. Refer to FIG. 5A.

Figure 5B:
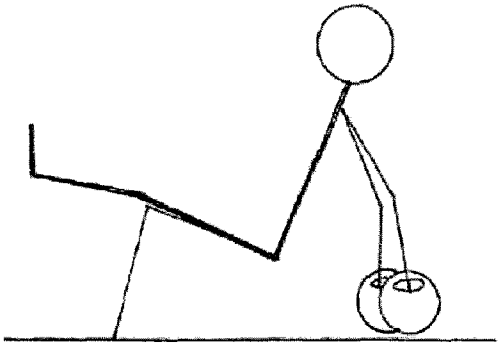

Step ii: Raise the left leg to where the knee is locked and in line with the right thigh, as shown in FIG. 5B.

Figure 5C:
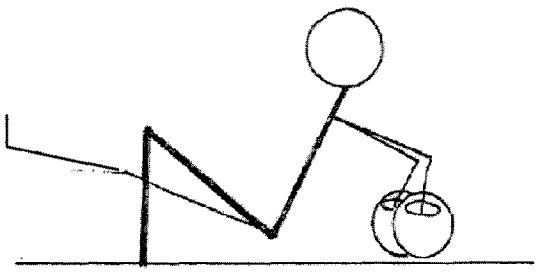

Step iii: While maintaining the left leg in the raised position, drop the hips toward the ground by bending the elbows, as shown in FIG. 5C, then return to the position of step ii.

Figure 5D:
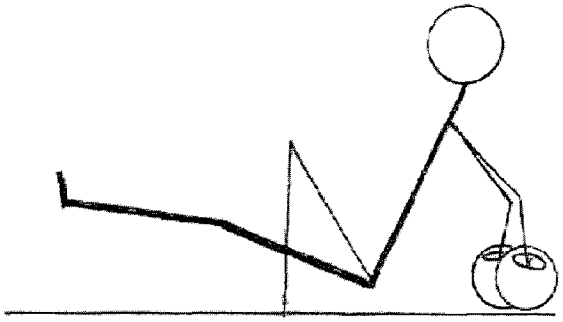

Step iv: Switch legs—raise the right leg to where the knee is locked and in line with the left thigh, and while maintaining the right leg in the raised position, drop the hips toward the ground by bending the elbows, as shown in FIG. 5D, then return to the position of step ii.

The primary muscles worked in Exercise 4 are the triceps, core, quadriceps and shoulders.

Figure 6A:
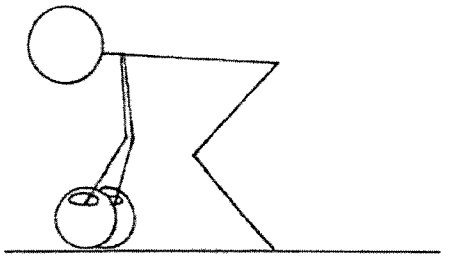
FIGS. 6A-6F illustrate a fifth series of exercises using the exercise ball of FIG. 1.

Exercise 5:

Step i: Start by placing the balls on the ground in front of you approximately shoulder width apart, as shown in FIG. 6A.

Figure 6B:
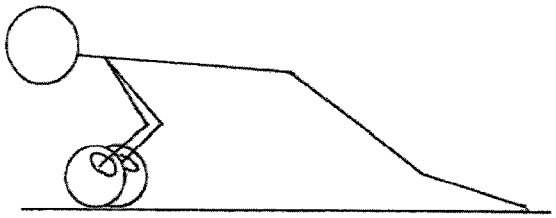

Step ii: In a single movement, pop your legs straight back out while simultaneously dropping the upper body down to a lowered push-up type position, with the toes curled under and the feet spread apart roughly the same distance as the balls, as shown in FIG. 6B.

Figure 6C:
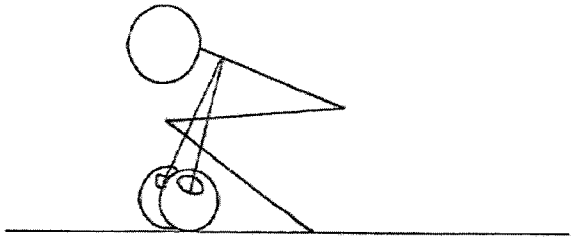

Step iii: In a single explosive movement, push up and also pop your legs back to the position of step i, as shown in FIG. 6C.

Figure 6D:
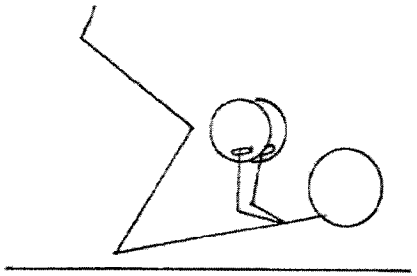

Step iv: Drop backward, rolling on your back toward the shoulders and head with the balls following, as in FIG. 6D.

Figure 6E:
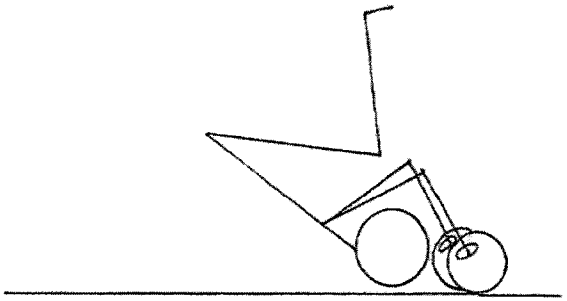

Step v: Utilizing the momentum of the roll, allow the balls to lightly touch the ground just above the head and your hips to roll up off the ground, as in FIG. 6E.

Figure 6F:
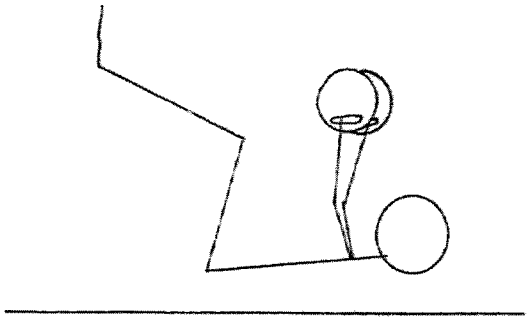

Step vi: Utilizing the momentum to go back the other way, allow the hips to drive back toward the ground and quickly bring the balls forward, as shown in FIG. 6F, until you are back in the Start position.

The primary muscles worked in Exercise 5 are the chest, core, abdominals and serratus anterior.

CONCLUSION

There are many other exercises that may be performed using the exercise ball described above. A detailed description of one or more embodiments has been provided above along with accompanying figures that illustrate the described subject matter. It should be understood that the description is not intended to be limiting, merely illustrative.

I claim:

1. An exercise device, comprising:

a solid metal spherical structure having a rigid surface, a hand-opening in the surface, a cavity in the approximate center of the spherical structure, and a passageway coupling the hand-opening and the cavity, wherein the hand-opening is relatively small and sized to accommodate insertion of a hand and forearm to permit only limited movement thereof during exercises, wherein the passageway increases in size toward the cavity, and wherein the cavity is relatively larger and sized to more freely accommodate the hand; and a rigid handle laterally positioned in the cavity and affixed in the approximate center of the spherical structure.

2. The exercise device of claim 1, wherein the spherical structure is formed of a molded material.

3. The exercise device of claim 2, wherein the handle is integrally molded with the spherical structure.

4. The exercise device of claim 1, wherein the spherical structure is coated with a surface material.

5. The exercise device of claim 4, wherein the handle is coated with a surface material.

6. The exercise device of claim 5, wherein the surface material is a rubber coating.

7. The exercise device of claim 1, wherein the spherical structure has a weight ranging from 5 to 150 pounds.

8. An exercise method, comprising:

providing at least one exercise apparatus comprising a solid metal spherical structure having a rigid surface, a hand-opening in the surface, a cavity in the approximate center of the spherical structure, and a passageway coupling the hand-opening and the cavity, wherein the hand-opening is relatively small and sized to accommodate insertion of a hand and forearm to permit only limited movement thereof during exercises, wherein the passageway increases in size toward the cavity, and wherein the cavity is relatively larger and sized to more freely accommodate the hand, and a rigid handle laterally positioned in the cavity and affixed in the approximate center of the spherical structure;

grasping the handle of the exercise apparatus with a user's hand; and the user performing one or more exercises with the exercise apparatus.

9. The method of claim 8, the exercise comprising a series of push-up and rows using the exercise apparatus.

10. The method of claim 9, further comprising the following sequence of steps:

a. grasping each handle of a pair of exercise apparatuses with a respective hand of the user;

b. taking a ready position for a push-up by placing the pair of exercise apparatuses on the ground;

c. dropping down to a push-up lowered position until the chest is even with the top of the exercise apparatuses;

d. pushing up with a first hand while pulling up with the second hand;

e. returning to the push-up lowered position of step c;

f. pushing up with the second hand while pulling up with the first hand; and g. repeating as desired.

11. The method of claim 9, further comprising the following sequence of steps:

a. grasping each handle of a pair of exercise apparatuses with a respective hand of the user;

b. standing with feet set shoulder width apart and the exercise apparatuses hanging down by the user's sides;

c. placing the exercise apparatuses straight down in front of the user;

d. in a single movement, thrusting the legs straight back and out to hold the body and legs straight in a push-up ready position;

e. in a single movement, moving the legs back to under the user as in step c and then jumping straight up into the air with the exercise apparatuses hanging at the side;

f. landing then curling the exercise apparatuses up toward the chest; and g. returning to step b and repeating as desired.

12. The method of claim 9, further comprising the following sequence of steps:

a. grasping each handle of a pair of exercise apparatuses with a respective hand of the user;

b. placing the exercise apparatuses on the ground at shoulder width apart in front of the user by bending knees and keeping feet set shoulder width apart;

c. in a single movement, thrusting the legs straight back while simultaneously dropping the upper body down to a position even with the tops of the exercise apparatuses;

d. in a single movement, moving the legs back to under the user as in step b;

e. rolling backward on the back toward the shoulders and head with the exercise apparatus following;

f. utilizing the momentum of the roll, allowing the exercise apparatuses to lightly touch the ground above the head and allowing the hips to roll up off the ground;

g. utilizing the momentum of the roll to go back the other way, allowing the hips to drive back toward the ground and quickly bringing the exercise apparatuses forward; and h. returning to step b and repeating as desired.

13. The method of claim 8, the exercise comprising swinging the exercise apparatus.

14. The method of claim 13, further comprising the following sequence of steps:

a. grasping each handle of a pair of exercise apparatuses with a respective hand of the user;

b. standing with feet set at shoulder width apart and holding the exercise apparatuses up near the shoulders;

c. dropping the exercise apparatuses in a small arc down between the legs while dropping down into a squat position;

d. pushing up with the feet in order to swing the exercise apparatuses back up in a small arc by pulling on the exercise apparatuses with the upper body;

e. dropping down into a squat position and absorbing the weight of the exercise apparatuses and then holding the exercise apparatuses even with the shoulders;

f. pushing up with the feet and pushing the exercise apparatuses up over the head;

g. returning to step b and repeating as desired.

15. The method of claim 8, further comprising the following sequence of steps:

a. grasping each handle of a pair of exercise apparatuses with a respective hand of the user;

b. placing the exercise apparatuses on the ground set a shoulder width apart, and simultaneously placing feet on the ground and together in front of the user, with knees bent and hips raised off the ground;

c. raising a first leg to where the knee is locked in line with the thigh of the second leg;

d. while maintaining the first leg in the raised position, dropping the hips toward the ground by bending the elbows, then returning to the position of step b;

e. raising the second leg to where the knee is locked in line with the thigh of the first leg;

f. while maintaining the second leg in the raised position, dropping the hips toward the ground by bending the elbows, then returning to the position of step b;

g. repeating as desired.

* * * * *